US011352974B2

(12) United States Patent
Pursifull et al.

(10) Patent No.: US 11,352,974 B2
(45) Date of Patent: Jun. 7, 2022

(54) SYSTEM AND METHOD FOR INJECTING FUEL TO AN ENGINE

(71) Applicant: Ford Global Technologies, LLC, Dearborn, MI (US)

(72) Inventors: Ross Pursifull, Dearborn, MI (US); Paul Hollar, Belleville, MI (US); David Oshinsky, Trenton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/017,791

(22) Filed: Sep. 11, 2020

(65) Prior Publication Data

US 2022/0082059 A1 Mar. 17, 2022

(51) Int. Cl.
*F02D 41/38* (2006.01)
*F02D 41/40* (2006.01)

(52) U.S. Cl.
CPC ..... *F02D 41/3863* (2013.01); *F02D 41/402* (2013.01); *F02D 2041/389* (2013.01); *F02D 2200/0616* (2013.01)

(58) Field of Classification Search
CPC .... F02D 19/02; F02D 19/024; F02D 19/0002; F02D 19/0025; F02D 19/0052; F02D 33/00; F02D 35/0046; F02D 41/3863; F02D 41/402; F02D 2200/0616; F02D 2041/389; F02D 41/061; F02D 41/345; F02D 41/365; F02D 41/40; F02D 41/401; F02D 1/16; F02D 2001/0085; F02D 2200/0618; F02B 19/1052; F02B 19/1085; B60W 2510/0619; B60W 2710/0622; G01M 15/00
USPC ..... 701/101, 103, 105
See application file for complete search history.

(56) References Cited

U.S. PATENT DOCUMENTS

| | | | | |
|---|---|---|---|---|
| 6,234,012 | B1 | 5/2001 | Lewis et al. | |
| 9,593,637 | B2 * | 3/2017 | Surnilla | F02D 19/0628 |
| 2011/0106393 | A1 | 5/2011 | Pursifull | |
| 2018/0334984 | A1 * | 11/2018 | Thomas | F02D 41/402 |
| 2019/0211787 | A1 * | 7/2019 | Thomas | F02D 41/40 |
| 2019/0338720 | A1 * | 11/2019 | Banker | F02D 41/3082 |
| 2021/0017928 | A1 * | 1/2021 | Thomas | F02D 41/2451 |

OTHER PUBLICATIONS

Pursifull, R. et al., "System and Method for Injecting Fuel to an Engine," U.S. Appl. No. 16/835,654, filed Mar. 31, 2020, 39 pages.

* cited by examiner

*Primary Examiner* — John Kwon
*Assistant Examiner* — Johnny H Hoang
(74) *Attorney, Agent, or Firm* — Geoffrey Brumbaugh; McCoy Russell LLP

(57) ABSTRACT

Methods and systems are provided for accounting for a difference between an expected amount of fuel scheduled to be delivered and an actual amount of fuel delivered to an engine cylinder during a fueling event. In one example, a method may include scheduling a direct injection to a cylinder based on an estimated expected amount of fuel injected to the cylinder during an immediately previous injection event. The expected amount of fuel injected during the immediately previous injection event may be a function of an average fuel rail pressure during the immediately previous injection event.

14 Claims, 4 Drawing Sheets

SYSTEM AND METHOD FOR INJECTING FUEL TO AN ENGINE

FIELD

The present description relates generally to methods and systems for accounting for a difference between an expected amount of fuel scheduled to be delivered and an actual amount of fuel delivered to an engine cylinder during a fueling event.

BACKGROUND/SUMMARY

A fuel injection system may include a fuel rail that supplies fuel to a plurality of fuel injectors coupled to engine cylinders. Fuel that is in the fuel rail may be pressurized so that fuel may be injected into an intake port of a cylinder or directly into a cylinder. Fuel injection event for a cylinder may be scheduled prior to the actual injection based on a fuel rail pressure at the time of scheduling. Due to a change in conditions of the fuel system after injection scheduling but before or during fuel injected, there may be a difference in a desired quantity of fuel to be delivered and an actual amount of fuel delivered. In order to efficiently control engine operation and fueling, the controller may estimate and track the desired quantity of fuel, an actual fuel delivered, and a difference between the two quantities.

However, the inventors herein have recognized potential issues with such systems. As one example, typically fuel rail pressure does not remain constant over a duration of fuel injection. Fuel rail pressure increases during the stroke of a direct injection pump. Therefore, there is a change in fuel rail pressure between the time of scheduling the fueling event and the actual fuel injection. This difference in pressure during the fuel injection may lead to erroneous estimations of an expected amount of fuel injected. As such, the engine control system may recognize a difference between intended fueling and actual fueling such as due to an injection duration being shortened due to valve events. Catalyst fuel control is sensitive to the cumulative/average/integrated fueling relative to instantaneous fueling. To maintain an accurate integrated fuel amount, an actual fuel delivered may be tracked instead of an intended fueling. Inaccurate estimation of a difference between the expected amount of fuel injected and an actual amount of fuel injected may result in inaccuracies in future injection event scheduling.

In one example, the issues described above may be addressed by a method for adjusting an amount of fuel injected to a cylinder via a direct fuel injector during an injection event based on an estimated expected amount of fuel injected to the cylinder during an immediately previous injection event, the estimated expected amount of fuel injected being determined as a function of an average fuel rail pressure during the immediately previous injection event. In this way, the estimation of expected fuel injection amount may be refined and a difference between the expected fuel injection amount and actual fuel injection amount may be accurately estimated.

As one example, a pressure of the fuel rail may be monitored (sampled) over a duration of an injection event such as from before a start of injection to after an end of injection. An average pressure may be computed over the duration of the injection.

Upon completion of the injection event, an actual amount of fuel injected may be estimated based on a drop in fuel rail pressure during the injection. The expected amount of fuel injected may be estimated based on the actual pulse width of the injection and the estimated average pressure during the injection. A difference (fueling difference) between the expected amount of fuel injected and an actual amount of fuel injected may be estimated. The actual amount of fuel injected and the fueling difference may be used to adjust engine operating parameters such as future schedule of fueling events and catalyst control. A pressure-based injector balancing system may use the fueling difference to estimate an actual transfer function of the injector.

In this way, by sampling fuel rail pressure over a duration of an injection event, estimation of an expected amount of fuel injected and an actual amount of fuel injected during a scheduled injection event may be improved. By taking into account a change in fuel rail pressure during the injection event, the fueling difference due to a pressure difference between scheduled and delivery may be known and accounted for. The technical effect of accurately estimating a difference between the expected fuel injected and actual fuel injected is that accuracy of future fueling events may be improved. In the case of PBIB, by compensating part-to-part injector transfer function differences towards zero. Overall, an accurate estimation of a pressure dependency of a fueling event may be used for diagnostics of the fueling system and also to improve catalyst operation.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
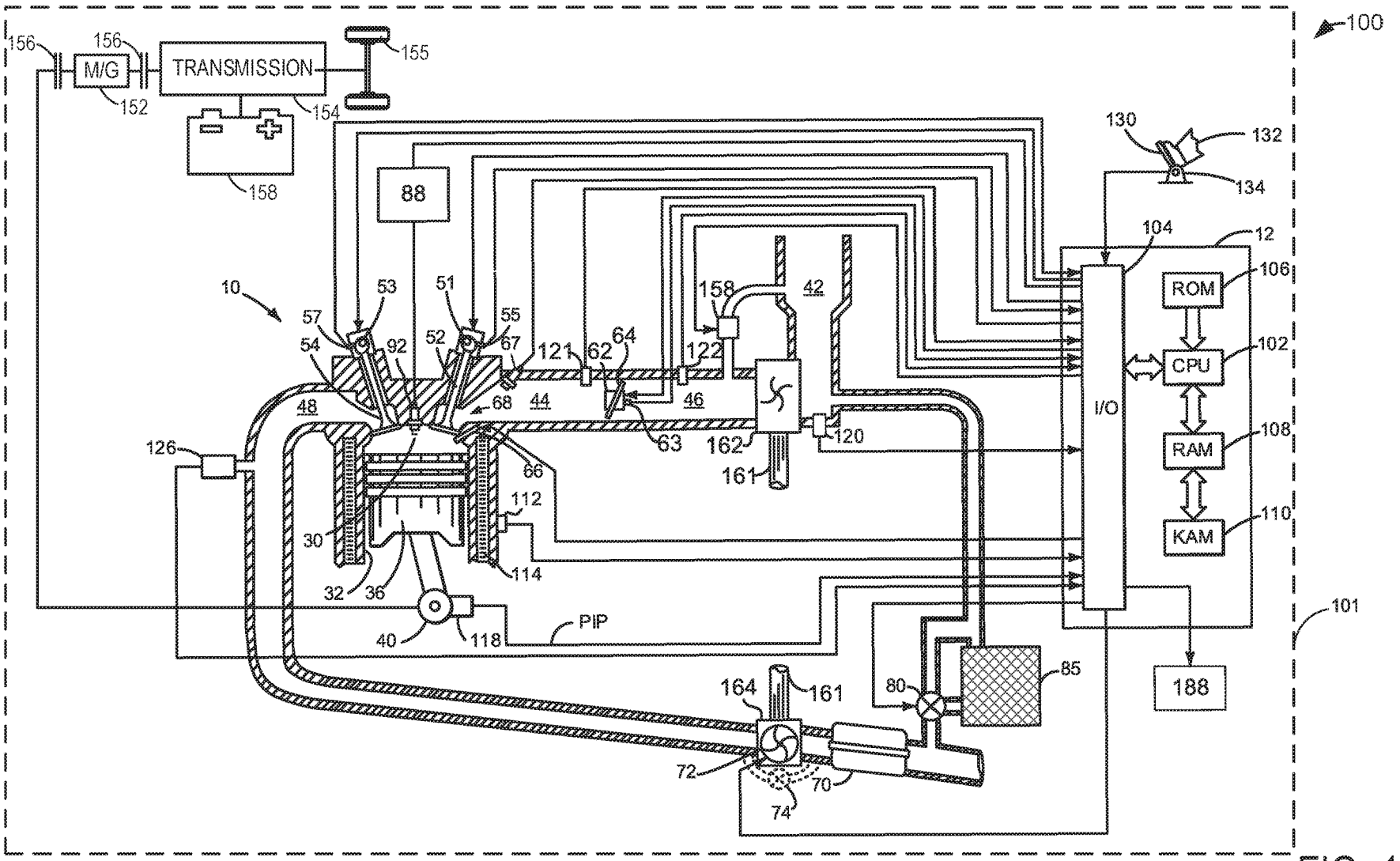
FIG. 1 shows a schematic depiction of an engine.
Figure 2:
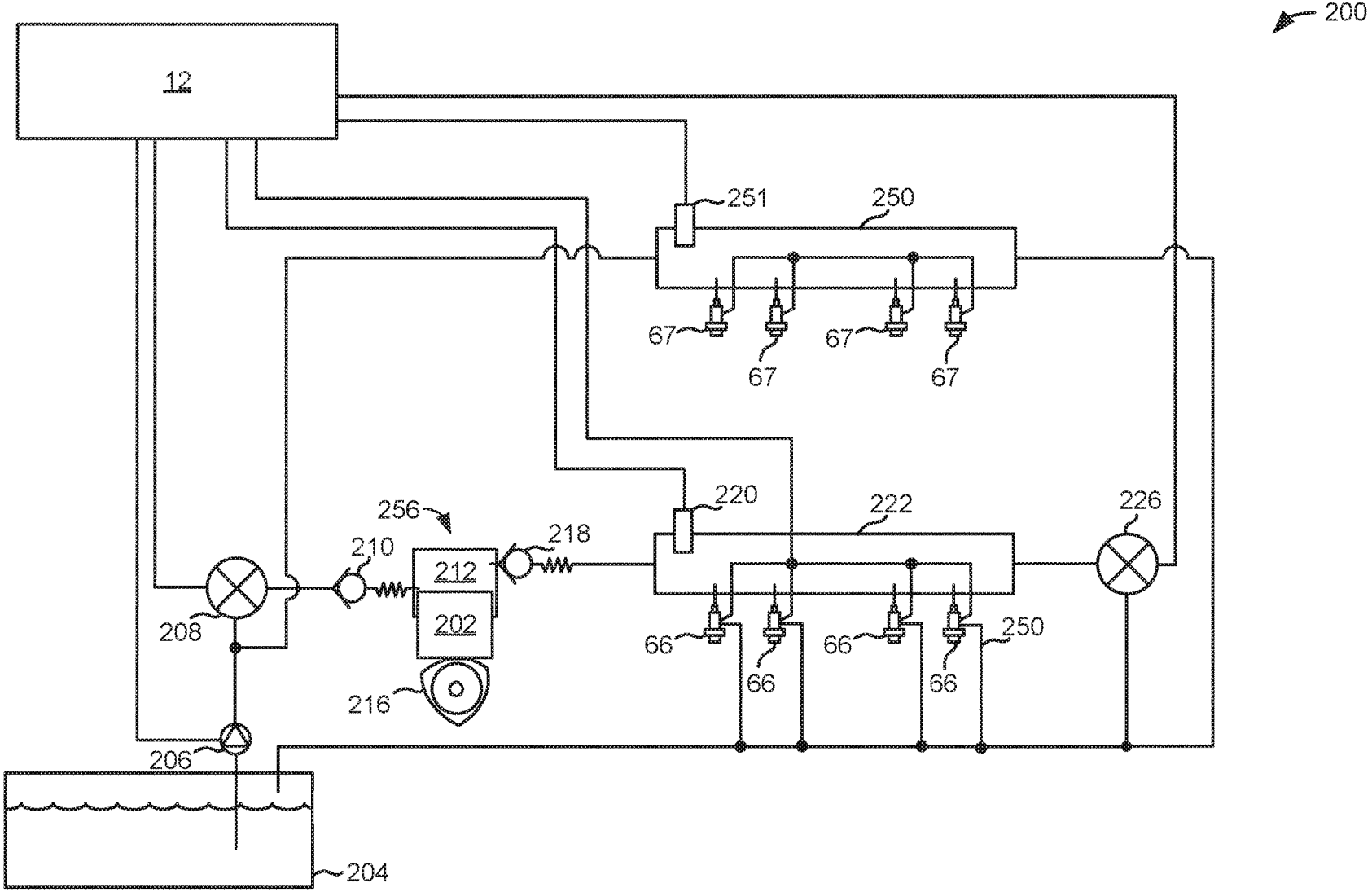
FIG. 2 shows a detailed depiction of a fuel system that supplies fuel to the engine.
Figure 3:
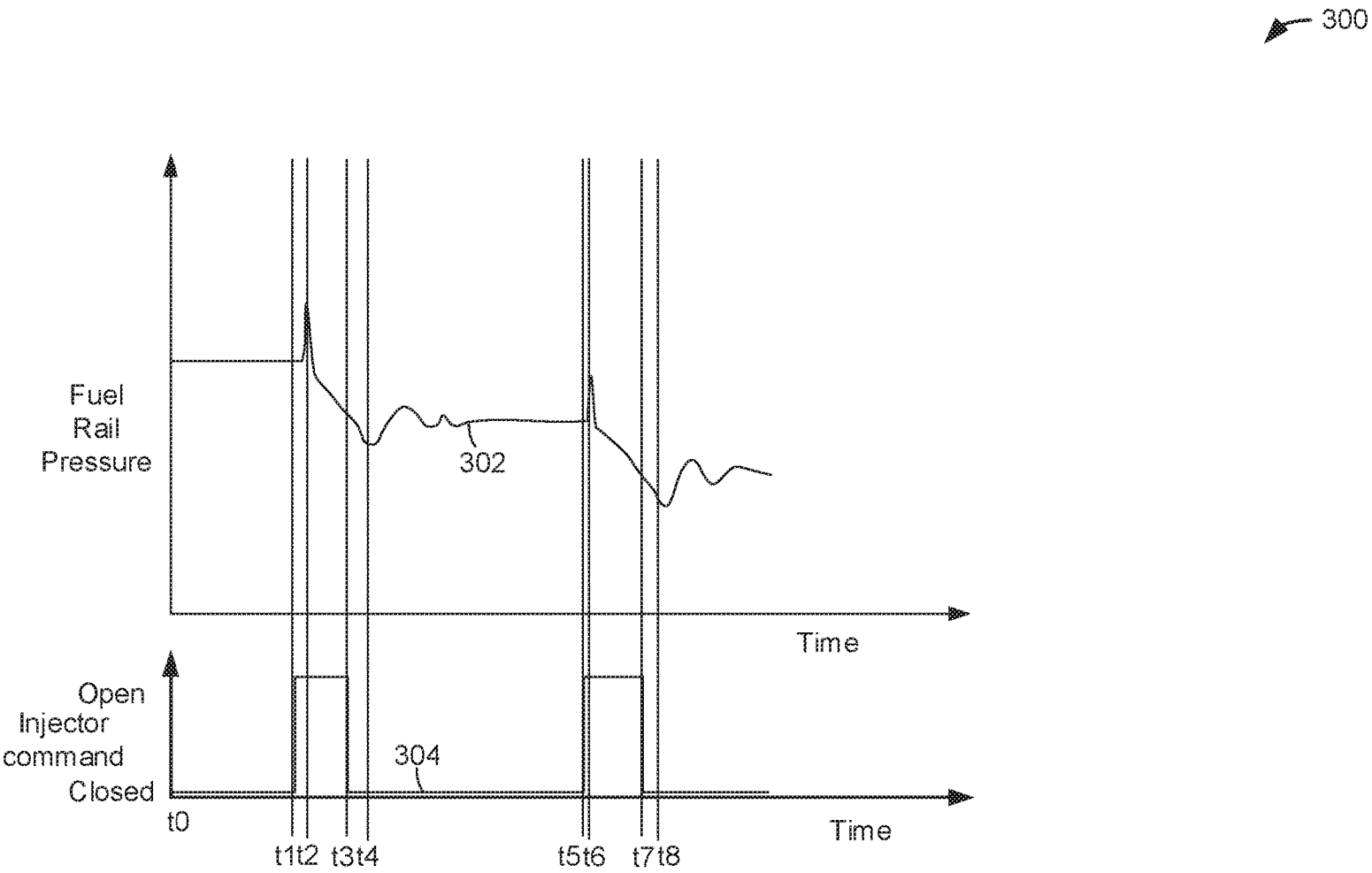
FIG. 3 shows a plot of fuel rail pressure variation during a fuel injection event.

The following description relates to systems and methods for accounting for a difference between an expected amount of fuel scheduled to be delivered and an actual amount of fuel delivered to an engine cylinder, such as an engine cylinder of an engine shown in FIG. 1, during a fueling event. The engine may include a fuel system as is shown in FIG. 2. Fuel rail pressure variations during fueling may be monitored as shown in the plot of FIG. 3. An engine controller may be configured to perform a control routine, such as the example routine of FIG. 4, to estimate a difference in fuel amount between an expected amount of fuel injected and an actual amount of fuel injected fueling the injection event and to adjust engine operation based on the difference.

FIG. 1 shows an example embodiment 100 of a vehicle 101 including an internal combustion engine 10. The engine 10 may comprise a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Fuel injector 66 is shown positioned to inject fuel directly into combustion chamber 30, which is known to those skilled in the art as direct injection. Fuel injector 66 delivers fuel in proportion to the pulse width of signal from controller 12. Fuel is delivered to fuel injector 66 by a fuel system as shown in FIG. 2. Fuel pressure delivered by the fuel pump may be adjusted by varying an inlet metering valve regulating flow to a fuel pump (not shown) and a fuel rail pressure control valve. In some examples, a second port fuel injector 67 may inject fuel to intake port 68.

Distributor-less ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Intake manifold 44 is shown communicating with optional electronic throttle 62 which adjusts a position of throttle plate 64 to control air flow from intake boost chamber 46. Compressor 162 draws air from air intake 42 to supply boost chamber 46. Exhaust gases spin turbine 164 which is coupled to compressor 162 via shaft 161. In some examples, a charge air cooler may be provided. Compressor speed may be adjusted via adjusting a position of variable vane control 72 or compressor bypass valve 158. In alternative examples, a waste gate 74 may replace or be used in addition to variable vane control 72. Variable vane control 72 adjusts a position of variable geometry turbine vanes. Exhaust gases can pass through turbine 164 supplying little energy to rotate turbine 164 when vanes are in an open position. Exhaust gases can pass through turbine 164 and impart increased force on turbine 164 when vanes are in a closed position. Alternatively, wastegate 74 allows exhaust gases to flow around turbine 164 so as to reduce the amount of energy supplied to the turbine. Compressor bypass valve 158 allows compressed air at the outlet of compressor 162 to be returned to the input of compressor 162. In this way, the efficiency of compressor 162 may be reduced so as to affect the flow of compressor 162 and reduce the possibility of compressor surge.

Exhaust gas recirculation (EGR) may be provided to the engine via EGR valve 80. EGR valve 80 is a three-way valve that closes or allows exhaust gas to flow from downstream of emissions device 70 to a location in the engine air intake system upstream of compressor 162. In alternative examples, EGR may flow from upstream of turbine 164 to intake manifold 44. EGR may bypass EGR cooler 85, or alternatively, EGR may be cooled via passing through EGR cooler 85. In other examples, high pressure and low pressure EGR system may be provided.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine temperature from temperature sensor 112; a position sensor 134 coupled to an accelerator pedal 130 for sensing force applied by human foot 132; a measurement of engine manifold pressure (MAP) from pressure sensor 121 coupled to intake manifold 44; an engine position sensor from a Hall effect sensor 118 sensing crankshaft 40 position; a measurement of air mass entering the engine from sensor 120; a fuel rail pressure from a fuel rail pressure sensor; and a measurement of throttle position from sensor 63. Barometric pressure may also be sensed for processing by controller 12. In a preferred aspect of the present description, engine position sensor 118 produces a predetermined number of equally spaced pulses every revolution of the crankshaft from which engine speed (RPM) can be determined.

Controller may send information and notifications to human/machine interface 188. In addition, human/machine interface 188 may receive input to operate engine 10 and/or a vehicle. Human/machine interface may be a touch screen or other known human/machine interface.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

In some examples, vehicle 101 may be a hybrid vehicle with multiple sources of torque available to one or more vehicle wheels 155. In other examples, vehicle 101 is a conventional vehicle with only an engine, or an electric vehicle with only electric machine(s). In the example shown, vehicle 101 includes engine 10 and an electric machine 152. Electric machine 152 may be a motor or a motor/generator. Crankshaft 40 of engine 10 and electric machine 152 are connected via a transmission 154 to vehicle wheels 155 when one or more clutches 156 are engaged. In the depicted example, a first clutch 156 is provided between crankshaft 140 and electric machine 152, and a second clutch 156 is provided between electric machine 152 and transmission 154. Controller 12 may send a signal to an actuator of each clutch 156 to engage or disengage the clutch, so as to connect or disconnect crankshaft 40 from electric machine 152 and the components connected thereto, and/or connect or disconnect electric machine 152 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 152 receives electrical power from a traction battery 158 to provide torque to vehicle wheels 155. Electric machine 152 may also be operated as a generator to provide electrical power to charge battery 158, for example during a braking operation.

Referring now to FIG. 2, a detailed depiction of a fuel system that supplies fuel to an engine is shown. The fuel system of FIG. 2 may be monitored in the engine system of FIG. 1 via the method of FIG. 4.

Fuel system 200 includes various valves and pumps that are controlled by controller 12. Fuel pressure in fuel rail 222 is sensed via pressure sensor 220. Controller 12 controls pressure in fuel rail 222 using pressure feedback from pressure sensor 220. Controller 12 activates low pressure fuel pump 206 to supply fuel to fuel pump flow metering valve 208 and optional port fuel injectors 67. Check valve 210 allows fuel to flow to high pressure fuel pump 256 and it limits back fuel flow from high pressure fuel pump 256. Fuel pump flow metering valve 208 controls the amount of fuel entering high pressure fuel pump 256. Cam 216 is driven by the engine and provides motive force to piston 202 which operates on fuel in pump chamber 212.

High pressure fuel pump 256 directs fuel to fuel injector rail 222 via check valve 218. Fuel pressure in fuel rail 222 may be controlled via adjusting valves 208 and 226. Fuel rail pressure control valve 226 may be positioned partially open during operating conditions such that at least a portion of fuel supplied by fuel pump 256 returns to fuel tank 204. Fuel rail pressure control valves 226 may be at least partially opened an additional amount during some conditions to reduce fuel pressure in the fuel rail 222. Fuel rail pressure control valve 226 may be at least partially closed during some conditions to increase fuel pressure in fuel rail 222. Fuel rail 222 may provide fuel to one cylinder bank of an engine via direct fuel injectors 66. Fuel rail pressure control valve 226 may be controlled separately from fuel pump flow metering valve 208 so that fuel pressure in fuel rail 222 may be adjusted by whichever valve or combination of valves provides a desired fuel pressure response.

Low pressure fuel pump 206 also supplies fuel to fuel rail 250. Port fuel injectors 67 are supplied fuel via fuel rail 250. Pressure in fuel rail 250 may be determined via pressure sensor 251. Fuel that is not injected during an engine cycle may be returned to fuel tank 204.

As such, fuel controls such as fuel injection timing and an amount of fuel injected may account for a difference between a scheduled fuel pulse width that is computed based on a last update of cylinder air charge estimate and a fuel pulse width realized. The pressure of the fuel rail 222 may vary over the course of an injection event with the pressure increasing during a stroke of the high pressure fuel pump 256 and then decreasing as fuel is delivered from the direct injectors 66. Therefore, there is a change in fuel rail pressure between the time of scheduling of a fueling event and the actual fuel injection. This pressure difference may lead to erroneous estimations of an expected amount of fuel injected. Inaccurate estimation of a difference between the expected amount of fuel injected and an actual amount of fuel injected (fueling difference) may result in inaccuracies in future injection event scheduling.

During a first injection of fuel to a cylinder via a direct fuel injector 66 coupled to the cylinder, a pressure in the fuel rail 222 coupled to the direct fuel injector 66 may be sampled. Upon completion of the first injection of fuel to the cylinder, a fueling amount (mass or volume) difference for the first injection may be estimated based on a change in pressure in the fuel rail during the first injection, and a second injection of fuel to the cylinder via the direct fuel 66 injector may be scheduled based on the prior fueling difference which may be an excess or a deficit. Scheduling the second injection of fuel may include scheduling a time of initiation of the second injection and an amount of fuel to be injected during the second injection based on the fueling difference. The second injection of fuel may be carried out immediately succeeding the first injection of fuel without any injection events for the cylinder in between. The fueling difference may be estimated as a difference between an expected amount of fuel delivered to the cylinder during the first injection and an actual amount of fuel delivered to the cylinder during the first injection. The expected amount of fuel delivered may be a function of the change in pressure in the fuel rail 222 during the first injection. In one example, the change in pressure may be an average pressure of a first pressure in the fuel rail upon opening of the direct fuel injector and a second pressure in the fuel rail upon closing of the direct fuel injector. In another example, the change in pressure is a root mean square (RMS) value of pressure sampled in the fuel rail during the first injection. In yet another example, change in pressure is an average of a square root of a ratio of actual fuel rail pressure and scheduled fuel rail pressure.

Thus, the system of FIGS. 1 and 2 provides for an engine system, comprising: a controller including executable instructions stored in a non-transitory memory that cause the controller to: estimate an average pressure in a fuel rail in fluidic communication with one or more direct fuel injectors during fueling of a cylinder via a direct fuel injector of the one or more direct fuel injectors, estimate an expected amount of fuel injected during the fueling of the cylinder as a function of the average pressure in the fuel rail, and adjust an amount of fuel injected to the cylinder via the direct fuel injector during another fueling of the cylinder immediately following the fueling.

Figure 4:
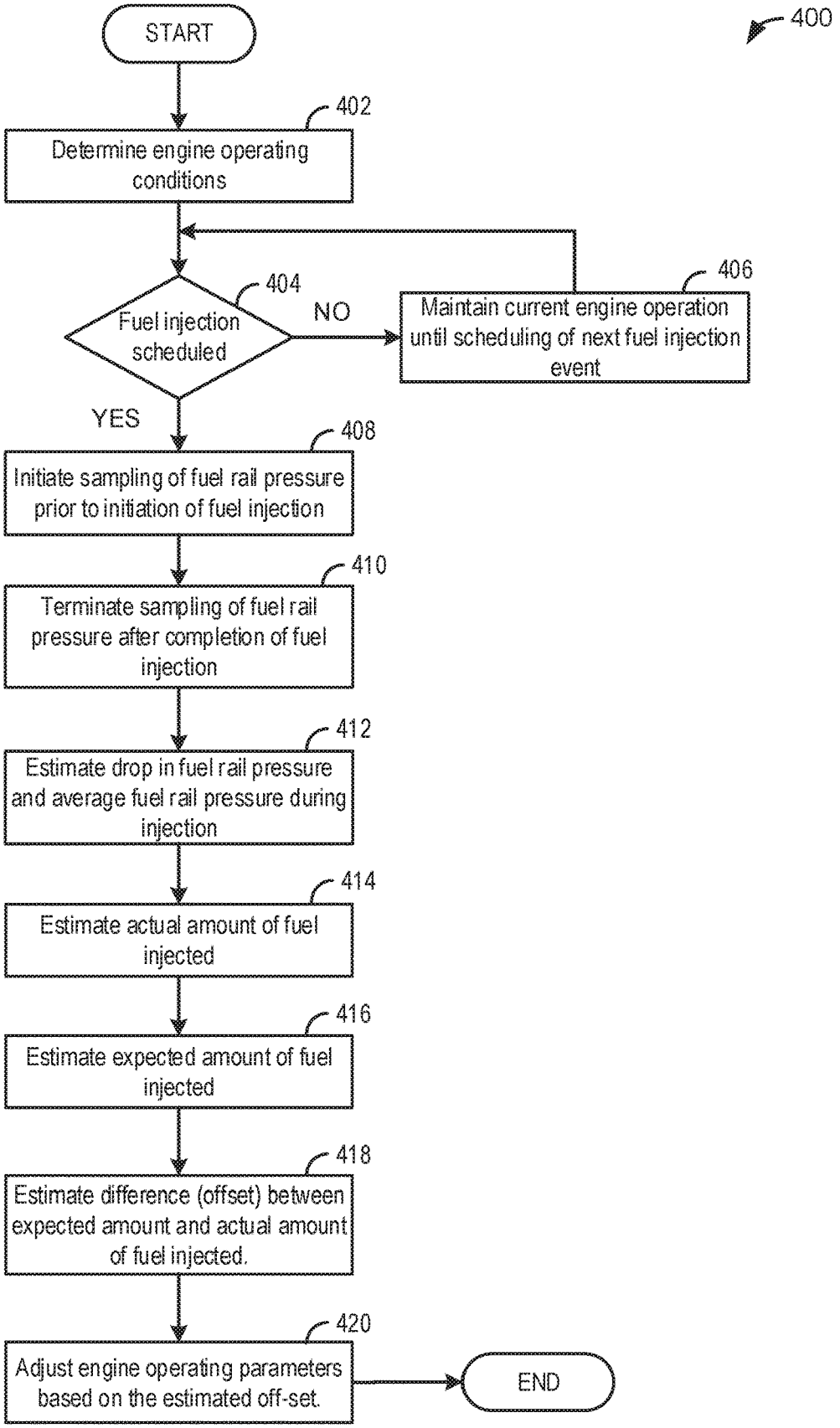
FIG. 4 shows flow chart of an example method for estimating a difference between an expected amount of fuel injected and an actual amount of fuel injected fueling the injection event.

FIG. 4 shows a flow chart of a method 400 for improving engine air-fuel ratio control and evaluating a fuel system for fuel injector degradation is shown. The method of FIG. 4 may be stored as executable instructions in non-transitory memory in systems such as shown in FIG. 1. The method of FIG. 4 may be incorporated into and may cooperate with the systems of FIGS. 1 and 2. Further, at least portions of the method of FIG. 4 may be incorporated as executable instructions stored in non-transitory memory while other portions of the method may be performed via a controller transforming operating states of devices and actuators in the physical world. The controller may employ actuators of the vehicle system to adjust vehicle operation, according to the method described below. Further, method 400 may determine selected engine and/or vehicle control parameters from sensor inputs.

At 402, method 400 determines engine operating conditions. Engine operating conditions may include but are not limited to engine speed, engine load, engine torque command, fuel pressure, fuel temperature, ambient pressure, and ambient temperature.

At 404, the routine includes determining if a fuel injection event is scheduled for one or more engine cylinders. Scheduling of fuel injection event may include scheduling a time and a pulse width of direct injection of fuel into a cylinder. The scheduled fuel pulse width may be based on a fuel rail pressure at the time of scheduling. Scheduling of fuel injection may be carried out prior to final cylinder air estimate is available and therefore, a changing cylinder air estimate may change the desired fuel injection amount (relative to the amount of fuel scheduled to be injected). As discussed herein, the controller may estimate an expected amount of fuel injected and an actual amount of fuel injected after completion of an injection event and use a difference between the expected amount and the actual amount to schedule the immediately following fueling event.

If it is determined that a fuel injection event is not scheduled such as during engine operating conditions where combustion is not being carried out in engine cylinders, at 406, current engine operation may be continued until scheduling of next fuel injection event. Conditions when combustion is not carried out in engine cylinders may include a deceleration fuel shut-off event such as when the vehicle is travelling downhill.

If it is determined that a fuel injection event is scheduled for a cylinder, at 408, sampling of fuel rail pressure may be initiated immediately prior to initiation of fuel injection to a first cylinder. The sampling may be initiated at a predetermined angle (such as 180 crank degrees) before the fuel injector for a first cylinder is commanded open, and the fuel pressure in a fuel rail may be sampled at a predetermined rate. Method 400 may also sample output commands to fuel injectors at the predetermined rate, or alternatively, fuel injector command values may be stored in controller random access memory. In one example, sampling fuel pressure includes converting pressure in a fuel rail to a voltage, the voltage is converted into a digital number via an A/D converter and stored in controller random access memory. As time changes, the voltage may be converted to a digital number at a predetermined frequency (e.g., sampling frequency of 100 kilo-Hertz) and stored to controller random access memory. Likewise, voltage of fuel injector commands and values of fuel injector commands may be stored as numbers in controller random access memory.

At 410, sampling of fuel rail pressure may be terminated after a predetermined amount of time (such as 10 seconds) has elapsed since the completion of fuel injection to the first cylinder such as after the injector for the first cylinder is commanded closed. At 412, a fuel rail pressure drop during the injection and an average fuel rail pressure during the injection may be estimated.

FIG. 3 shows a plot of fuel rail pressure variation during two consecutive injection events. FIG. 3 includes two plots and each of the two plots includes a horizontal axis that represents time. The plots are aligned in time. The first plot from the top of FIG. 3, as shown by line 302, is a plot of fuel pressure in a fuel rail or fuel rail pressure (in kPa) versus time (in second). The vertical axis represents fuel pressure in the fuel rail and fuel pressure increases in the direction of the vertical axis arrow. The horizontal axis represents time and time increases from the left hand side of the plot to the right hand side of the plot.

The second plot from the top of FIG. 3, as shown by line 304, is a plot of a fuel injector control commands for engine cylinders versus time. The fuel injectors are off or closed (e.g., not allowing fuel to flow from the injectors to the cylinders) when trace 304 is at a lower level near the horizontal axis. Then one of the engine's fuel injectors is open (e.g., allowing fuel to flow from the injector to the cylinder) when trace 304 is at a higher level near the vertical axis arrow.

In this example, when a high pressure fuel pump supplying fuel to the fuel rail is operated to pump the fuel, pressure in a fuel rail increases to a higher level and then the fuel pump is deactivated so that additional fuel is not pumped to the fuel rail. One or more injectors are then opened and closed and pressure in the fuel rail is reduced each time a fuel injector is opened.

At time t0, pressure in the fuel rail is high and the fuel pump is commanded not to replenish fuel in the fuel rail. The fuel injectors not commanded are maintained closed. At time t1, only one fuel injector (e.g., first fuel injector coupled to first cylinder) is commanded open. The pressure in the fuel rail increases prior to time t2 due to a high pressure (direct injection) pump stroke(s). The fuel pressure increases when the fuel injector opens since in the open position the inward opening injector reduces the trapped volume in the fuel rail, thus initialing compressing the existing trapped liquid fuel. Part of the height of the peak following t2 is due to a transient pressure pulse as the opening injector sends out a positive pressure pulse. The fuel pressure in the fuel rail drops shortly after time t2 as fuel is released from the fuel rail and into the engine cylinder. The first fuel injector for the first cylinder number is commanded closed at time t3. Fuel pressure in the fuel rail decreases at time t4 (and increases after time t4) indicating that the fuel injector is now closing. Sampling of pressure in the fuel rail may be continued from time t0 (prior to opening of the injector) to time t4 (after closing of the injector). The fuel rail pressure drop may be the difference between the peak pressure, as estimated at time t2, and the lowest fuel rail pressure attained at time t4 immediately after closing the injector. Alternatively, the fuel rail pressure drop may be estimated as a difference in pressure at time t1 when the injector is commanded to open and time t3 when the injector is commanded to be closed. The fuel rail pressure may remain substantially stable until another fueling event is initiated for another fuel injector. An average pressure may be computed throughout the inter-injection period sampled at the pre-determined time intervals.

At time t5, another fuel injector (e.g., a second fuel injector for a second cylinder) is commanded open. The pressure in the fuel rail increases to a peak pressure at time t6 and the fuel pressure in the fuel rail drops shortly after time t6 as fuel is released from the fuel rail and into the engine. The second fuel injector is commanded closed at time t7 and fuel pressure in the fuel rail increases after time t8 indicating that the fuel injector is now closed.

Returning to FIG. 4, an average fuel rail pressure value for an injection event for a first cylinder may be determined. In one example, the average pressure for five sample pressure values is given by equation 1:

$$P_{avg} = \frac{P1 + P2 + P3 + P4 + P5}{5} \quad (1)$$

where P1 is fuel rail pressure taken at a first time during injection of fuel to the cylinder, P2 is fuel rail pressure taken at a second time during injection of fuel to the cylinder, P3 is fuel rail pressure taken at a third time during injection of fuel to the cylinder, P4 is fuel rail pressure taken at a fourth time during injection of fuel to the cylinder, P5 is fuel rail pressure taken at a fifth time during injection of fuel to the cylinder, N is the number of fuel rail pressures sampled during the engine cycle, N=5 in this example. In this example, five pressure values are shown for brevity and a higher number of pressure values may be sampled over the course of the injection event. In another example, the controller may estimate the fuel rail pressure at the start of injection and at the end of injection and estimate the average fuel rail pressure as an average of the start and end pressure The fuel rail pressure drop during the injection event may be estimated the average between the pressure prior to injection and the pressure following injection. Alternatively, the fuel rail pressure drop may be estimated as a difference in pressure at the onset of injection when the injector is commanded to open and at the completion of injection when the injector is commanded to be closed.

At 414, an actual amount of fuel injected (fuel mass that left the fuel rail during an injection) may be estimated as a function of the estimated drop in fuel rail pressure during the injection event. The actual amount of fuel injected may be further based on an actual pulse width of fuel injection realized during the injection event. The actual pulse width may account for any late requested pulse width changes along with any truncations. In one example, the actual amount of fuel injected may be estimated based on fuel rail pressure drop, fuel density, effective bulk modulus, and fuel rail volume such as by using equation 2.

$$I_m = \frac{\Delta P \cdot \rho \cdot V}{K} \tag{2}$$

where $I_m$ is the actual amount (mass) of fuel injected, ΔP is a fuel rail pressure drop during the injection, ρ is fuel density, V is fuel rail volume, and K is effective bulk modulus.

At 416, an expected amount of fuel injected by the injector may be estimated. The expected amount of fuel injected may be estimated based on the actual pulse width of the injection and the estimated average fuel rail pressure during the injection.

At 418, a difference (fueling difference) between the expected amount of fuel and the actual fuel injected may be estimated. An improved estimation of the expected amount of fuel injected and the actual amount of fuel injected increases the accuracy of the fueling difference.

At 420, one or more engine operating parameters may be adjusted based on the estimated fueling difference. In one example, an amount of fuel injected during an immediately subsequent injection from the injector may be adjusted as a function of the fueling difference. In another example, a pressure based balancing system (PBIB) may adjust a transfer function of the injector based on the estimated fueling difference. As an example, a 10 mg fuel injection was scheduled to be injected at 10 MPa but the average pressure during injection is 9.7 MPa, the fuel mass actually injected is estimated to be 10 mg*sqrt(9.7/10)=9.85 mg. The fuel mass actually injected may be termed as mass scaled for actual fuel rail pressure during injection and this estimate may be used for adjustments made by the PBIB.

A direct fuel injector's gain or transfer function describes fuel flow through the direct fuel injector and/or an amount of fuel delivered via the direct fuel injector based on a pulse width of a voltage supplied to the direct fuel injector. As an example, a previously determined transfer function may be retrieved from a controller memory and updated based on the estimated fueling difference. The update may include multiplying the previously determined transfer function by a factor proportional to the fueling difference. Also, using the fueling difference, the PBIB may be able to compensate part-to-part transfer function differences towards zero. By accurately computing an actual transfer function of an injector, scheduling of fuel injection may be improved for the immediately subsequent fueling event for the injector.

In one example of learning and applying injector balancing where every DI injection has identical injection pressure and pulse width, the pressure drop due to an injection from each injector may be measured and converted to a mass (or volume). An injector mass ratio (injector index) may be computed as a function of an observed injection mass and an observed average injection mass for all injectors. An injector correction factor for an injector may be estimated as a function of the injector mass ratio and applied for injector balancing.

In yet another example, fueling diagnostics may be carried out based on the estimated fueling difference. A higher than threshold difference between the expected amount of fuel injected and the actual amount of fuel injected may adversely affect engine operation. As an example, in response to a higher than threshold fueling difference for an injector, a diagnostic code may be set indicating degradation of the injector. The threshold may be pre-calibrated during engine operation with non-degraded fuel injectors.

In this way, by accurately estimating the expected amount of fuel injected, an actual transfer function of an injector may be accurately computed. Further, cylinder-to-cylinder fuel-air ratio variation may be reduced thereby improving fuel economy and reducing pre and post-catalyst emissions.

In one example, a method for an engine, comprises: adjusting an amount of fuel injected to a cylinder via a direct fuel injector during an injection event based on an estimated expected amount of fuel injected to the cylinder during an immediately previous injection event, the estimated expected amount of fuel injected being determined as a function of an average fuel rail pressure during the immediately previous injection event. In the preceding example, the method further comprising, additionally or optionally, sampling a fuel rail pressure a plurality of times while the direct fuel injector is supplying fuel to the cylinder during the immediately previous injection event. In any or all of the preceding examples, additionally or optionally, the average fuel rail pressure is estimated from the sampled fuel rail pressure a plurality of times during the immediately previous injection event. In any or all of the preceding examples, additionally or optionally, the sampling of fuel rail pressure is continued from a pre-determined time prior to initiation of fuel injection to the cylinder during the immediately previous injection event to another pre-determined time after completion of fuel injection to the cylinder during the immediately previous injection event. In any or all of the preceding examples, additionally or optionally, the average fuel rail pressure is estimated as a function of a first fuel rail pressure estimated at the initiation of fuel injection and a second fuel rail pressure estimated at the completion of fuel injection during the immediately previous injection event. In any or all of the preceding examples, additionally or optionally, adjusting the amount of fuel injected to the cylinder based on the estimated amount of fuel injected to the cylinder during the immediately previous injection event includes increasing or decreasing the amount of fuel injected as a function of a difference between the estimated expected amount of fuel injected and an estimated actual amount of fuel injected during the immediately previous injection event without any injection events between the injection event and the immediately previous injection event. In any or all of the preceding examples, additionally or optionally, the actual amount of fuel injected during the immediately previous injection event is estimated as a function of a fuel rail pressure drop during the immediately previous injection event. In any or all of the preceding examples, additionally or optionally, the expected amount of fuel is estimated as a function of the average fuel rail pressure during the immediately previous injection event and the pulse width of the immediately previous injection event. Any or all of the preceding examples, further comprising, additionally or optionally, adjusting a transfer function of the direct fuel injector based on the difference between the estimated expected amount of fuel injected and the estimated actual amount of fuel injected.

In another example, a system for an engine, comprises: a controller including executable instructions stored in a non-transitory memory that cause the controller to estimate an average pressure in a fuel rail in fluidic communication with one or more direct fuel injectors during fueling of a cylinder via a direct fuel injector of the one or more direct fuel injectors, estimate an expected amount of fuel injected during the fueling of the cylinder as a function of the average pressure in the fuel rail, and adjust an amount of fuel injected to the cylinder via the direct fuel injector during another fueling of the cylinder immediately following the fueling. In any or all of the preceding examples, additionally or optionally, during the fueling, a pressure in the fuel rail increases with a stroke of a high pressure fuel pump in fluidic communication with the fuel rail and the pressure in the fuel rail decreases after completion of injection of the fuel. Any or all of the preceding examples, further comprising, additionally or optionally, sampling the pressure in the fuel rail via a pressure sensor coupled to the fuel rail a predetermined number of times during the fueling of the cylinder and then estimating the average pressure in the fuel rail as a function of the sampled pressure and the predetermined number of times the pressure is sampled. In any or all of the preceding examples, additionally or optionally, the expected amount of fuel injected is a function of the average pressure and a pulse width of the fueling. Any or all of the preceding examples, further comprising, additionally or optionally, estimating an actual amount of fuel injected to the cylinder during the fueling as a function of a difference between a first pressure in the fuel rail at initiation of the fueling and a second pressure in fuel rail at completion of fueling and the pulse width of the fueling, the first pressure higher than the second pressure. In any or all of the preceding examples, additionally or optionally, adjusting the amount of fuel injected to the cylinder via the direct fuel injector during another fueling of the cylinder immediately following the fueling is based on a difference between the expected amount of fuel injected and the actual amount of fuel injected.

In yet another example, a method for an engine, comprises: during a first injection of fuel to a cylinder via a direct fuel injector coupled to the cylinder, sampling a pressure in a fuel rail coupled to the direct fuel injector, upon completion of the first injection of fuel to the cylinder, estimating a fueling offset for the first injection based on a change in pressure in the fuel rail during the first injection, and scheduling a second injection of fuel to the cylinder via the direct fuel injector based on the fueling offset, the second injection of fuel immediately succeeding the first injection of fuel. In the preceding example system, additionally or optionally, the fueling offset is estimated as a difference between an expected amount of fuel delivered to the cylinder during the first injection and an actual amount of fuel delivered to the cylinder during the first injection, the expected amount of fuel delivered being a function of the change in pressure in the fuel rail during the first injection. In any or all of the preceding examples, additionally or optionally, the change in pressure is an average pressure of a first pressure in the fuel rail upon opening of the direct fuel injector and a second pressure in the fuel rail upon closing of the direct fuel injector. In any or all of the preceding examples, additionally or optionally, scheduling the second injection of fuel includes scheduling a time of initiation of the second injection and an amount of fuel to be injected during the second injection based on the fueling offset.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

sampling fuel rail pressure from immediately prior to initiation of a fuel injection to a cylinder via a direct fuel injector to after completion of the fuel injection to the cylinder;

estimating, based on the sampling, each of an average fuel rail pressure and a drop in fuel rail pressure during the fuel injection;

estimating an expected amount of fuel injected to the cylinder based on the average fuel rail pressure;

estimating an actual amount of fuel injected to the cylinder based on the drop in fuel rail pressure; and adjusting an amount of fuel injected to the cylinder via the direct fuel injector during an immediately subsequent injection event based on the estimated expected amount of fuel injected to the cylinder during the fuel injection.

2. The method of claim 1, where the sampling the fuel rail pressure is carried out a plurality of times while the direct fuel injector is supplying fuel to the cylinder during the fuel injection.

3. The method of claim 2, wherein the sampling of fuel rail pressure is continued from a pre-determined time prior to the initiation of the fuel injection to the cylinder to another pre-determined time after the completion of fuel injection to the cylinder during the immediately previous injection event.

4. The method of claim 3, wherein the average fuel rail pressure is estimated as a function of a first fuel rail pressure estimated at the initiation of the fuel injection and a second fuel rail pressure estimated at the completion of the fuel injection.

5. The method of claim 1, wherein adjusting the amount of fuel injected to the cylinder based on the estimated amount of fuel injected to the cylinder includes increasing or decreasing the amount of fuel injected as a function of a difference between the estimated expected amount of fuel injected and the estimated actual amount of fuel injected.

6. The method of claim 5, wherein the actual amount of fuel injected during the immediately previous injection event is estimated as a function of the drop in fuel rail pressure and an actual pulse width of the fuel injection.

7. The method of claim 6, wherein the expected amount of fuel is estimated as a function of the average fuel rail pressure, and the actual pulse width of the fuel injection.

8. The method of claim 5, further comprising, adjusting a transfer function of the direct fuel injector based on the difference between the estimated expected amount of fuel injected and the estimated actual amount of fuel injected.

9. A system for an engine, comprising:

a controller including executable instructions stored in a non-transitory memory that cause the controller to:

estimate an average pressure in a fuel rail in fluidic communication with one or more direct fuel injectors during fueling of a cylinder via a direct fuel injector of the one or more direct fuel injectors;

estimate a drop in pressure in the fuel rail during fueling of the cylinder via the direct fuel injector;

estimate an expected amount of fuel injected during the fueling of the cylinder as a function of the average pressure in the fuel rail;

estimate an actual amount of fuel injected during the fueling of the cylinder as another function of the drop in fuel rail pressure; and adjust an amount of fuel injected to the cylinder via the direct fuel injector during another fueling of the cylinder immediately following the fueling based on each of the estimated expected amount of fuel injected and the estimated actual amount of fuel injected.

10. The system of claim 9, wherein during the fueling, the pressure in the fuel rail increases with a stroke of a high pressure fuel pump in fluidic communication with the fuel rail and the pressure in the fuel rail decreases after completion of injection of the fuel.

11. The system of claim 9, further comprising, sampling the pressure in the fuel rail via a pressure sensor coupled to the fuel rail a predetermined number of times during the fueling of the cylinder and then estimating the average pressure based on the sampled pressure and the predetermined number of times the pressure is sampled.

12. The system of claim 9, wherein the expected amount of fuel injected is the function of the average pressure and a pulse width of the fueling.

13. The system of claim 12, wherein the actual amount of fuel injected to the cylinder during the fueling as the another function of a difference between a first pressure in the fuel rail at initiation of the fueling and a second pressure in fuel rail at completion of fueling, the first pressure higher than the second pressure.

14. The system of claim 13, wherein adjusting the amount of fuel injected to the cylinder via the direct fuel injector during another fueling of the cylinder immediately following the fueling is based on a difference between the expected amount of fuel injected and the actual amount of fuel injected.

* * * * *